United States Patent [19]

Valentine

[11] Patent Number: 4,800,612

[45] Date of Patent: Jan. 31, 1989

[54] VACUUM POWER BOOSTER WITH AUTOMATIC WASTE LIQUID DISCHARGE FOR A WATER VACUUM EXTRACTION APPARATUS

[75] Inventor: Edward R. Valentine, Pinckney, Mich.

[73] Assignee: Cross American Corporation, Ann Arbor, Mich.

[21] Appl. No.: 123,725

[22] Filed: Nov. 23, 1987

[51] Int. Cl.[4] ..... A47L 7/00

[52] U.S. Cl. ..... 15/314; 15/321; 15/353

[58] Field of Search ..... 15/353, 321, 314, 302, 15/320

[56] References Cited

U.S. PATENT DOCUMENTS

| | | | |
|---|---|---|---|
| 1,204,478 | 11/1916 | Noakes . | |
| 1,923,689 | 8/1933 | Rosenberg | 15/353 X |
| 1,975,380 | 10/1934 | Streich et al. | 15/50 |
| 2,149,453 | 3/1939 | Longshore et al. | 15/50 |
| 2,317,843 | 4/1943 | Backlund | 15/50 |
| 3,559,230 | 2/1971 | Ogle | 15/302 |
| 3,774,260 | 11/1973 | Emus | 15/353 X |
| 3,848,290 | 11/1974 | Bates | 15/321 |
| 3,869,749 | 3/1975 | London et al. | 15/302 |
| 4,080,104 | 3/1978 | Brown | 15/353 X |
| 4,087,881 | 5/1978 | Bates | 15/300 A |
| 4,112,538 | 9/1978 | Bates | 15/353 X |
| 4,137,599 | 2/1979 | Steyer | 15/353 X |
| 4,475,264 | 10/1984 | Schulz | 15/300 A |

OTHER PUBLICATIONS

Unbelievable Results, Brochure-Cross American.

*Primary Examiner*—Chris K. Moore

*Attorney, Agent, or Firm*—Basile, Hanlon

[57] ABSTRACT

A vacuum power booster with automatic waste liquid discharge for a water vacuum extraction apparatus. A first vacuum source is coupled to a first waste liquid storage tank in a main housing, typically vehicle mounted. A second, auxilliary vacuum source is mounted in a mobile housing remotely located from the first housing which contains a second auxilliary waste liquid storage tank. A vacuum pickup implement is coupled to the mobile waste liquid storage tank for extracting and transmitting dirty liquid from the surface being cleaned to the second waste liquid storage tank. The liquid in the second waste liquid storage tank is automatically discharged and transmitted to the first waste liquid storage tank when the level of such liquid reaches a predetermined height or level within the second waste liquid storage tank. An outlet formed at a predetermined height above the bottom of the mobile housing in communication with the second waste liquid storage tank is connected by a conduit to the first waste liquid storage tank to discharge liquid to the first waste liquid storage tank when such liquid level reaches the outlet. Alternately, a valve is interposed between the outlet in the mobile housing and a conduit connecting the mobile housing to the first waste liquid storage tank for selectively opening and closing the fluid flow connection between the first and second waste liquid storage tanks depending upon the level of waste liquid within the second waste liquid storage as detected by a liquid level detector.

4 Claims, 1 Drawing Sheet

VACUUM POWER BOOSTER WITH AUTOMATIC WASTE LIQUID DISCHARGE FOR A WATER VACUUM EXTRACTION APPARATUS

BACKGROUND OF THE INVENTION

1. Field of the Invention

This invention relates, in general, to carpet cleaning apparatus and, more specifically, to carpet cleaning apparatus which dispense a cleaning fluid onto a surface to be cleaned and utilize vacuum to extract the dirty solution from the surface.

2. Description of the Prior Art

Various cleaning apparatus have been devised to clean carpets, rugs and the like. A typical carpet cleaning device is in the form of a housing containing two liquid storage tanks; one for a cleaning solution or chemical and another for waste or dirty liquid extracted from the carpet under vacuum pressure. The cleaning solution is applied to the surface through a movable applicator or wand. Then, a vacuum is applied through the wand to extract dirty liquid from the carpet as the wand is moved along the carpet. The dirty or waste liquid is then transmitted by the vacuum pressure to the dirty liquid storage tank in the housing.

In large scale or commercial cleaning operations, the liquid storage housing is typically mounted in a vehicle, such as a truck. The liquid application and vacuum lines extend from the truck mounted vacuum source and liquid storage tanks to the area to be cleaned.

In order to increase the vacuum pressure for large scale applications, such cleaning apparatus have been constructed with multiple, co-axially arranged vacuum pumps or motors. This enables greater amounts of dirty liquid to be extracted from a carpet. Such devices have also been constructed with one vacuum pump or motor mounted in a mobile housing, which is remotely movable with respect to the main vacuum source and truck mounted liquid storage housing, with the remote unit serving as the dirty liquid storage tank. However, the remote liquid storage tank must be emptied numerous times during large scale cleaning operations which increases the time required to clean a large area.

Thus, it would be desirable to provide a water vacuum extraction apparatus which is capable of providing increased vacuum extraction pressure to simplify carpet cleaning operations. It would also be desirable to provide a vehicle mounted vacuum extraction apparatus having a remotely located, mobile, auxilliary vacuum source and waste liquid storage tank with automatic discharge of waste liquid from the remotely mobile storage tank to a main waste liquid storage tank mounted on the vehicle.

SUMMARY OF THE INVENTION

The present invention is a vacuum power booster with automatic waste liquid discharge for a water vacuum extraction apparatus. The apparatus includes a mobile housing containing a waste liquid storage chamber or tank and a vacuum source, such as a vacuum generating pump or motor, operably connected to and generating a vacuum pressure within the waste liquid storage tank. A main unit, typically vehicle mounted, includes a first vacuum source coupled to a first or main waste liquid storage tank. The waste liquid storage tanks in the remote, mobile housing and the vehicle mounted housing are connected in fluid flow communication by a suitable conduit or hose.

Automatic discharge means are provided for automatically discharging the waste liquid from the mobile waste liquid storage tank to the vehicle mounted first waste liquid storage tank when the liquid level within the remote waste liquid storage tank reaches a predetermined level within the mobile housing. This is achieved by positioning the outlet of the waste liquid storge tank in the mobile housing at a predetermined height above the bottom of the waste liquid storage tank. The vacuum generated in the first liquid storage tank then through the interconnecting conduit or hose sucks the waste liquid from the upper surface of the waste liquid in the mobile housing when the liquid level rises to the bottom of the outlet in the mobile housing. In this manner, the bottom portion of the mobile waste liquid storage tank serves as temporary storage for extracted waste liquid as well as enabling the mobile housing to be automatically emptied of waste liquid extracted from the surface being cleaned.

In another embodiment, the automatic discharge means includes a valve movable between open and closed position and interposed between the conduit connecting the first and second waste liquid storage tanks. The valve is responsive to an output signal generated by a liquid level detector means mounted within the second waste liquid storage tank. The output signal from the liquid level detector is generated when the level of the waste liquid in the mobile or second waste liquid storage tank reaches a predetermined level. When the waste liquid reaches this level, the valve is opened for a predetermined amount of time thereby automatically discharging waste liquid under vacuum pressure generated by the first vacuum source in the vehicle mounted housing from the mobile waste liquid storage tank to the first or main waste liquid storage tank in the vehicle.

The unique vacuum power booster with automatic waste liquid discharge of the present invention provides significant improvements over previously devised vacuum extraction cleaning apparatus in that the total operation time required in large scale cleaning operations is significantly reduced since the mobile or auxilliary waste liquid storage tank need not be emptied from time to time as it fills up with waste liquid extracted from the surface being cleaned. The automatic discharge means of the present invention discharges excess waste liquid buildup in the mobile tank to the waste liquid storage tank in the main, vehicle mounted unit as required thereby eliminating manual emptying of the tank as required with previously devised vacuum extraction cleaning apparatus. In addition, the utilization of a second vacuum source in the mobile housing significantly increases the total vacuum pressure in the cleaning apparatus thereby enabling greater quantities of waste liquid to be extracted from the surface being cleaned over previously devised carpet cleaning apparatus employing a single vacuum pump or motor or multiple vacuum sources mounted in the main unit.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
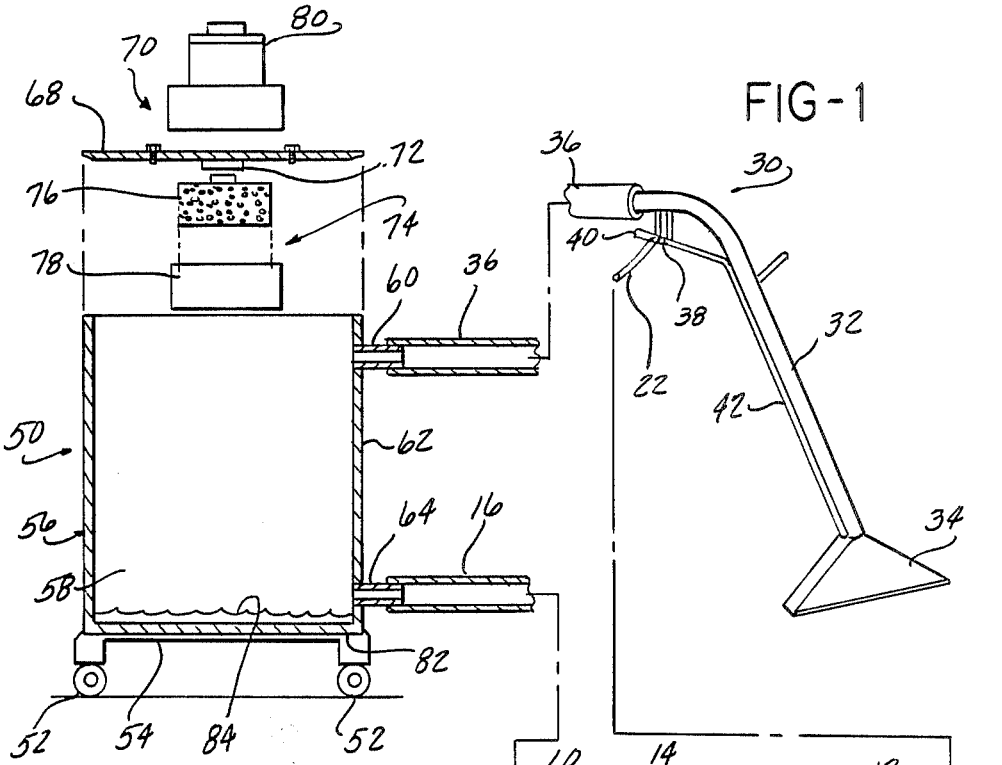
FIG. 1 is an elevational view of a water vacuum extraction apparatus utilizing a remote vacuum power booster having automatic waste liquid discharge constructed according to the present invention.

Throughout the following description and drawing, an identical reference number is used to refer to the same component shown in multiple figures of the drawing.

The present invention is a remotely located, mobile vacuum power booster having automatic waste liquid discharge for a water vacuum extraction apparatus. As shown in FIG. 1, the water vacuum extraction apparatus includes a main housing 10 which is typically stationary and/or stationarily mounted in a vehicle, such as a truck. The main housing 10 includes a first waste or dirty liquid storage tank 12 housed interially therein as well as a storage tank, not shown, containing a cleaning solution or chemical to be sprayed onto the surface to be cleaned. A first vacuum source 14, which may be any conventional vacuum pump or motor, is operably coupled to the first waste liquid storage tank 12 and provides a vacuum pressure within the interior of the first waste liquid storage tank 12 to draw waste liquid extracted from the surface being cleaned through a conduit 16 into the first waste liquid storage tank 12. Air is exhausted through the outlet of the vacuum motor or pump 14 in a conventional manner.

The housing 10 is also provided with a number of gauges 18 to monitor the system pressure, fluid flow rate, etc., of the cleaning apparatus. Also, an outlet coupling 20 is provided in the housing 10 for connection to a conduit or hose 22 which extends between and connects in fluid flow communication the cleaning solution tank in the housing 10 and an applicator wand 30.

The applicator 30 is a conventional hand-held, movable spray and vacuum pickup applicator wand having an elongated hollow tube 32 which is connected at one end to a wedge-shaped spray and extraction head 34. The tube 32 serves as a discharge conduit for dirty liquid extracted from the surface being cleaned through the pickup head 34 as the head 34 is moved across the surface and directs such extracted dirty liquid through a flexible conduit or hose 36 connected at the opposite end of the tube 32 to a remote waste storage tank, as described hereafter. Also, the applicator 30 includes an on/off valve 38 controlled by a manually movable handle or switch 40 which controls the application of cleaning solution through the hose 22 to a hose 42 mounted on the tube 32 and connected to the wedgeshaped head 34.

It should be noted that the main vacuum extraction apparatus described above is by way of example only and that any conventional water vacuum extraction apparatus may be employed with the present invention.

As shown in FIG. 1, the water vacuum extraction apparatus of the present invention also includes a mobile housing 50 which is remotely located from and movable with respect to the main housing 10. The housing 50 is made mobile by the use of wheels or casters 52 mounted on a bottom frame 54. A housing 56 is mounted on the frame 54 and has a hollow interior 58 which forms an auxilliary or second waste liquid storage tank.

An inlet means 60 in the form of a hollow conduit extends through a sidewall 62 of the housing 56 and provides an input port for connection of the conduit 36 attached to the vacuum pickup applicator 30 to the mobile housing 56 for the transmission of dirty liquid extracted from the surface being cleaned into the second waste liquid storage tank 56. Further, an outlet 64 is mounted a predetermined distance above the bottom of the housing 56, preferably in the sidewall 62 of the housing 56. The outlet 64, which may be in the form of a hollow conduit extending through the sidewall 62 of the housing 56, provides a fluid flow connection for the discharge conduit or hose 16 connected to the first waste liquid storage tank 12 in the main housing 10.

A cover 68 is removably attachable to the top end of the sidewall 62 of the housing 56 to form a sealed housing for the second waste liquid storage tank 56.

A vacuum source, denoted in general by reference number 70, is mounted in the cover 68 and extends partially therethrough into the interior 58 of the second waste liquid storage tank 58. The second vacuum source 70 may be any source or means capable of generating a vacuum, such as a motor driven fan, for example, or a three stage Lamb vacuum bypass motor. A suitable vacuum pump may also be employed as long as it is capable of generating the required amount of vacuum pressure within the second waste liquid storage tank 56.

The inlet 72 of the motor 70 extends into the interior of the second waste liquid storage tank 56 and is surrounded by filter means denoted in general by reference number 74. By way of example only and not limitation, the filter means 74 is formed of a two part filter assembly including an inner or first filter formed in an annular ring 76 and having a plurality of perforations formed in the side walls thereof for trapping lint or solid particles as air drawn through the motor 70 passes therethrough into the inlet 72 of the motor 70. An outer filter 78 formed of a different filtering media, such as foam, is removably implacable around the inner filter 76 for trapping additional dirt and debris from air passing from the interior 58 of the housing 56 through the motor 70. The outlet of the motor 70 may be provided with a suitable air silencer, not shown, for exhausting air from the mobile housing 50.

The second vacuum source 70 in conjunction with the first vacuum source 14 in the main housing 10 combine to form a high vacuum pressure within the second waste liquid storage tank 56 which is capable of extracting large quantities of waste or dirty liquid through the vacuum pickup applicator 30 and transmitting such liquid into the second waste liquid storage tank 56.

The apparatus of the present invention also includes automatic discharge means for automatically discharging liquid from the second waste liquid storage tank 56 to the first waste liquid storage tank 12 when the waste liquid in the second waste liquid storage tank 56 reaches a predetermined level within the interior 58 of the second waste liquid storage tank 56. This is achieved in one embodiment of the present invention by positioning the outlet 64 in the mobile housing 56 at a predetermined distance above the bottom surface 82 of the housing 56 as shown in FIG. 1. In this manner, the bottom portion of the second waste liquid storage tank 56 serves as a storage chamber for waste liquid extracted from the surface being cleaned. When the liquid level denoted by reference number 84 reaches the bottom of the outlet 64, excess liquid above the bottom of the outlet 64 is extracted by the vacuum pressure generated by the first vacuum source 14 in the main housing 10 through the outlet 64 and conduit 16 to the first waste liquid storage tank 12 in the main housing 10. This process automatically continues as additional quantities of waste liquid are extracted from the surface being cleaned and discharged into the second waste liquid storage tank 58 thereby maintaining the surface level 84 of the waste liquid in the second waste liquid storage tank 56 at the predetermined level set by the location of the outlet 64.

Figure 2:
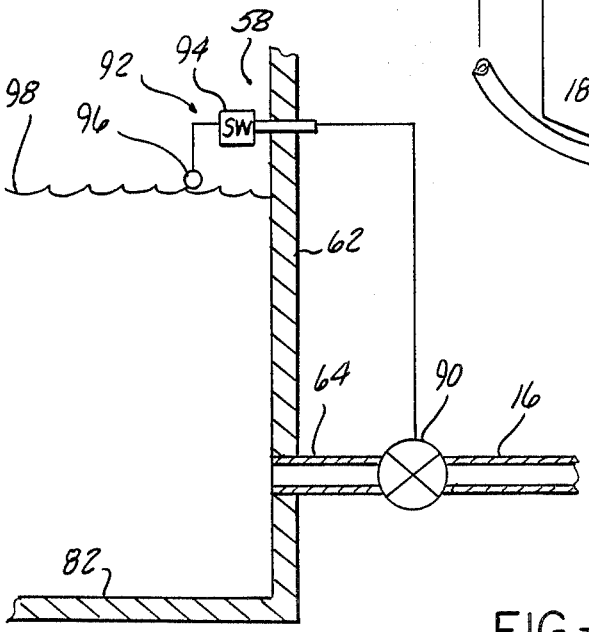
FIG. 2 is a partially sectioned view of another embodiment of the automatic discharge means usable with a water vacuum extraction apparatus.

According to another embodiment of the present invention depicted in FIG. 2, the automatic discharge means includes valve means 90 operably connected between the outlet 64 and the conduit 16. The valve means 90 which may be any conventional valve, such as an electrically operated solenoid valve, is movable between open and closed positions, either closing or disposing in fluid flow communication the outlet 62 and the discharge conduit 16 upon receiving an activation signal from a liquid level detection means 92 mounted in the interior 58 of the second waste liquid storage tank 56. The level detector means 92 may be any conventional liquid level detector, such as a switch 94 mounted in the sidewall 62 of the housing 56 which is activated by a float arm 96 movable by contact with the upper surface level 98 of the liquid within the second waste liquid storage tank 56. When the level 98 of the waste liquid reaches the level shown in FIG. 2, the switch 94 is activated and generates an output signal which is transmitted to the valve 90 energizing the valve 90 and switching its ports to an open position placing the outlet 64 of the second waste liquid storage tank 56 and the discharge conduit 16 in fluid flow communication for the discharge of waste liquid from the second waste liquid storage tank 56 to the first waste liquid storage tank 12 in the main housing 10. The valve 90 is maintained in its open, fluid conducting position for a predetermined amount of time after being energized to enable a significant quantity of the waste liquid built up within the second waste liquid storage tank 56 to be discharged to the main housing 10.

In summary, there has been disclosed a unique vacuum power booster for a water vacuum extraction apparatus having automatic discharge of waste liquid from a mobile, remotely located vacuum extraction waste liquid storage reservoir to a waste liquid storage reservoir in a main vacuum extraction unit. The use of a second vacuum source in the remote, mobile housing in conjunction with the vaccum generated by the main vacuum unit increases the total vacuum pressure in the extraction apparatus so as to enable greater quantities of waste or dirty liquid to be extracted from the surface being cleaned than previously possible with currently available carpet cleaning apparatus. The automatic discharge of the waste liquid from the remote, mobile housing to the waste liquid storage tank in the main housing simplifies the use of the mobile unit by reducing the amount of time required for a large scale cleaning operation since the mobile waste liquid storage tank need not be repeatedly manually emptied as previously required with currently available water vacuum extraction apparatus.

What is claimed is:

1. A vacuum power booster having automatic waste liquid discharge for a water vacuum extraction apparatus comprising:

a first housing;

a first waste liquid storage tank disposed in the first housing;

a first vacuum generating means, mounted in the first housing and operably connected to the first waste liquid storage tank, for drawing waste liquid into the first waste liquid storage tank under vacuum pressure;

a second housing remotely located from the first housing;

a second waste liquid storage tank disposed in the second housing;

a second vacuum generating means operably mounted in the second housing and connected to the second waste liquid storage tank for drawing waste liquid into the second waste liquid storage tank;

a vacuum pickup means connected to the second waste liquid storage tank for conducting waste liquid extracted from the surface being cleaned under vacuum pressure to the second waste liquid storage tank;

means for connecting the first and second waste liquid storage tanks in fluid flow communication; and automatic discharge means for automatically discharging liquid from the second waste liquid storage tank to the first waste liquid storage tank only when the waste liquid in the second waste liquid storage tank and rises above the bottom of the tank to a predetermined level within the second waste liquid storage tank.

2. A vacuum power booster having automatic waste liquid discharge for a water vacuum extraction apparatus comprising:

a first housing;

a first waste liquid storage tank disposed in the first housing;

a first vacuum generating means, mounted in the first housing and operably connected to the first waste liquid storage tank, for drawing waste liquid into the first waste liquid storage tank under vacuum pressure;

a second housing remotely located from the first housing;

a second waste liquid storage tank disposed in the second housing;

a second vacuum generating means operably mounted in the second housing and connected to the second waste liquid storage tank for drawing waste liquid into the second waste liquid storage tank;

a vacuum pickup means connected to the second waste liquid storage tank for conducting waste liquid extracted from the surface being cleaned under vacuum pressure to the second waste liquid storage tank;

means for connecting the first and second waste liquid storage tanks in fluid flow communication; and automatic discharge means for automatically discharging liquid from the second waste liquid storage tank to the first waste liquid storage tank through the connecting means only when the waste liquid in the second waste liquid storage tank rises above the bottom of the tank to a predetermined level within the second waste liquid storage tank; the discharge means including:

an outlet formed in the second housing at a predetermined distance above the bottom of the second housing; and the connecting means comprises a conduit connecting the outlet in the second housing to the first waste liquid storage tank such that the vacuum pressure generated in the first waste liquid storage tank draws waste liquid through the outlet and conduit into the first waste liquid storage tank when the level of waste liquid in the second waste liquid storage tank reaches the outlet.

3. A vacuum power booster having automatic waste liquid discharge for a water vacuum extraction apparatus comprising:

a first housing;

a first waste liquid storage tank disposed in the first housing;

a first vacuum generating means, mounted in the first housing and operably connected to the first waste liquid storage tank, for drawing waste liquid into the first waste liquid storage tank under vacuum pressure;

a second housing remotely located from the first housing;

a second waste liquid storage tank disposed in the second housing;

a second vacuum generating means operably mounted in the second housing and connected to the second waste liquid storage tank for drawing waste liquid into the second waste liquid storage tank;

a vacuum pickup means connected to the second waste liquid storage tank for conducting waste liquid extracted from the surface being cleaned under vacuum pressure to the second waste liquid storage tank;

means for connecting the first and second waste liquid storage tanks in fluid flow communication; and automatic discharge means for automatically discharging liquid from the second waste liquid storage tank to the first waste liquid storage tank through the connecting means when the waste liquid in the second waste liquid storage tank reaches a predetermined level within the second waste liquid storage tank; the discharge means including:

an outlet formed in the second housing in fluid flow communication with the second waste liquid storage tank in the second housing;

the connecting means comprising a conduit connecting the outlet in the second housing to the first waste liquid storage tank in the first housing;

liquid level detector means mounted in the second waste liquid storage tank for detecting the level of the liquid within the second waste liquid storage tank and generating an output signal when the liquid level reaches a predetermined height within the second waste liquid storage tank; and valve means, responsive to the output from the level detector means and operably connected between the outlet and the conduit, for selectively disposing the outlet in fluid flow communication with the conduit when the level of waste liquid within the second waste liquid storage tank reaches the predetermined height.

4. The vacuum power booster of claim 1 wherein the second housing is mobile.

* * * * *